US006008551A

United States Patent [19]

Coray

[11] Patent Number: 6,008,551

[45] Date of Patent: Dec. 28, 1999

[54] LIGHT CONTROL KEYBOARD

[75] Inventor: John B Coray, 144 Taft, Pocatello, Id. 83201

[73] Assignee: John B Coray, Pocatello, Id.

[21] Appl. No.: 09/016,494

[22] Filed: Jan. 30, 1998

[51] Int. Cl.[6] ..... H02J 9/02; A63J 17/00

[52] U.S. Cl. ..... 307/157; 84/478; 315/129

[58] Field of Search ..... 307/157, 29, 38, 307/113–115, 119, 154; 315/130–132, 136, 210, 217, 129; 84/464 R, 464 A, 478, 479 R; 439/43, 49, 535

[56] References Cited

U.S. PATENT DOCUMENTS

| | | | |
|---|---|---|---|
| 3,958,486 | 5/1976 | Sears | 84/464 R |
| 4,109,231 | 8/1978 | Krouse . | |
| 4,331,062 | 5/1982 | Rogers | 84/478 |
| 4,434,454 | 2/1984 | Day . | |
| 4,928,568 | 5/1990 | Snavely | 84/464 |
| 5,394,784 | 3/1995 | Pierce | 84/464 |
| 5,557,055 | 9/1996 | Breitweiser, Jr. | 84/478 |

*Primary Examiner*—Richard T. Elms

[57] ABSTRACT

A portable light control keyboard for electrically energizing illuminating devices using piano keys, wherein each piano key, when depressed, activates switches so as to provide power to a receptacle into which an illuminating device such as a light or bank of lights is connected. The portable light control keyboard provides a visual rhythmic accompaniment to musical performances and productions.

2 Claims, 2 Drawing Sheets

LIGHT CONTROL KEYBOARD

BACKGROUND—FIELD OF INVENTION

The present invention relates generally to entertainment device for controlling lights and more particularly to a light control keyboard electrically connected where each piano type key will control one light or one bank of lights.

BACKGROUND—DESCRIPTION OF PRIOR ART

Light control switch panels have been developed using conventional switches that are manually operated to turn lights on and off. Prior art has utilized both portable and fixed position units. In each case the operator must engage each switch to illuminate a light. This type of operation has limitations. The switches are awkward to operate when making rapid and flowing changes. Individual switches must be activated manually. Hand movements must be coordinated to accommodate the layout of switches on a console.

Inventors have created several types of switching devices to control lights. U.S. Pat. No. 4,109,231 to Krouse (1978) discloses a portable switch console which can control six different outlets for lights. It also can dim the lights. This type of switching panel allows the operator to control six separate lights. Switches must be either in an on position or pressed into the off position. It would be difficult to make numerous and rapid changes to the lighting display.

U.S. Pat. No. 4,434,454 to Day (1984) shows a light control console. This invention would make it difficult for an inexperienced operator to activate the lights in a flowing manner. If used to accompany music with a visual light display the switches are awkward and cumbersome to activate. U.S. Pat. No. 4,928,568 to Snavely (1990) is a light display and is used in conjunction with a organ. These lights are illuminated in response to audio input. The device thus has no switch control of its own.

Several organs have been adapted to aid a person learning to play music for example, U.S. Pat. No. 4,331,062 to Rogers (1982), U.S. Pat. No. 5,394,784 to Pierce et al. (1995) and U.S. Pat. No. 5,557,055 to Breitweiser (1996) all utilize a sound producing organ. These sounds then activate lights and indicate if the correct notes are being played. The illumination of the lights corresponds to the notes being played, thus requiring the operator to be skilled in music. The lights are visible to the person playing the organ. The operator is thus playing music they are not playing the lights. The switching devices heretofore known suffer from a number of disadvantages:

(a) Light switching consoles offer limited operation by use of conventional switches. Hand movements must be coordinated to activate switches. Each operator would have limited ability depending on the layout of the console. Such consoles are used to provide a light display but do not give the versatility which would be required to make rapid and variable changes.

(b) Organs are musical instruments which require many hours of practice to enable a person to use them in a proficient manner. A knowledge of music is needed to play the organ. Therefore a person unskilled in the production of music would be at a great disadvantage for operating musical keyboard of any kind which illuminated lights using audio output.

OBJECTS AND ADVANTAGES

Accordingly, several objects and advantages of the present invention are:

(a) to provide a light control keyboard which can offer the operator the versatility of a musical keyboard.

(b) to provide a light control keyboard which can be portable.

(c) to provide a light control keyboard which is compatible with existing, easily accessible lights.

(d) to provide a light control keyboard which allows the operator to play the lights.

(e) to provide a light control keyboard which utilizes the versatility of a piano keyboard to activate lights.

(f) to provide a light control keyboard which utilizes common types of lights e.g., flood lights or decorative lights such as Christmas lights.

(g) to provide a piano type keyboard for controlling lights which requires no knowledge of music or training on a keyboard instrument.

(h) to make the illumination of a light or bank of lights convenient and simple, so as to allow any person the opportunity to create an exciting, quality light display.

Further objects and advantages are to provide a light control keyboard which can be used easily and conveniently to illuminate lights, without requiring the operator to be trained or skilled. Still further objects and advantages will become apparent from a consideration of the ensuing description and drawings.

DRAWING FIGURES

SUMMARY

In accordance with the present invention a light control keyboard comprising a piano type keyboard where each key is electrically connected to control a light or bank of lights. The keyboard connects to a common electrical outlet which supplies power to the invention. Each key when depressed activates a switch completing the circuit and power is distributed to a receptacle. Lights are plugged into the receptacle and illuminated when a key is depressed. This allows the operator the ability to play the lights as one would play music. A visual color display can be played in conjunction with audio output.

It is therefore an object of the present invention to provide a portable light control keyboard which will allow a person great flexibility for the illumination of lights.

Figure 1:
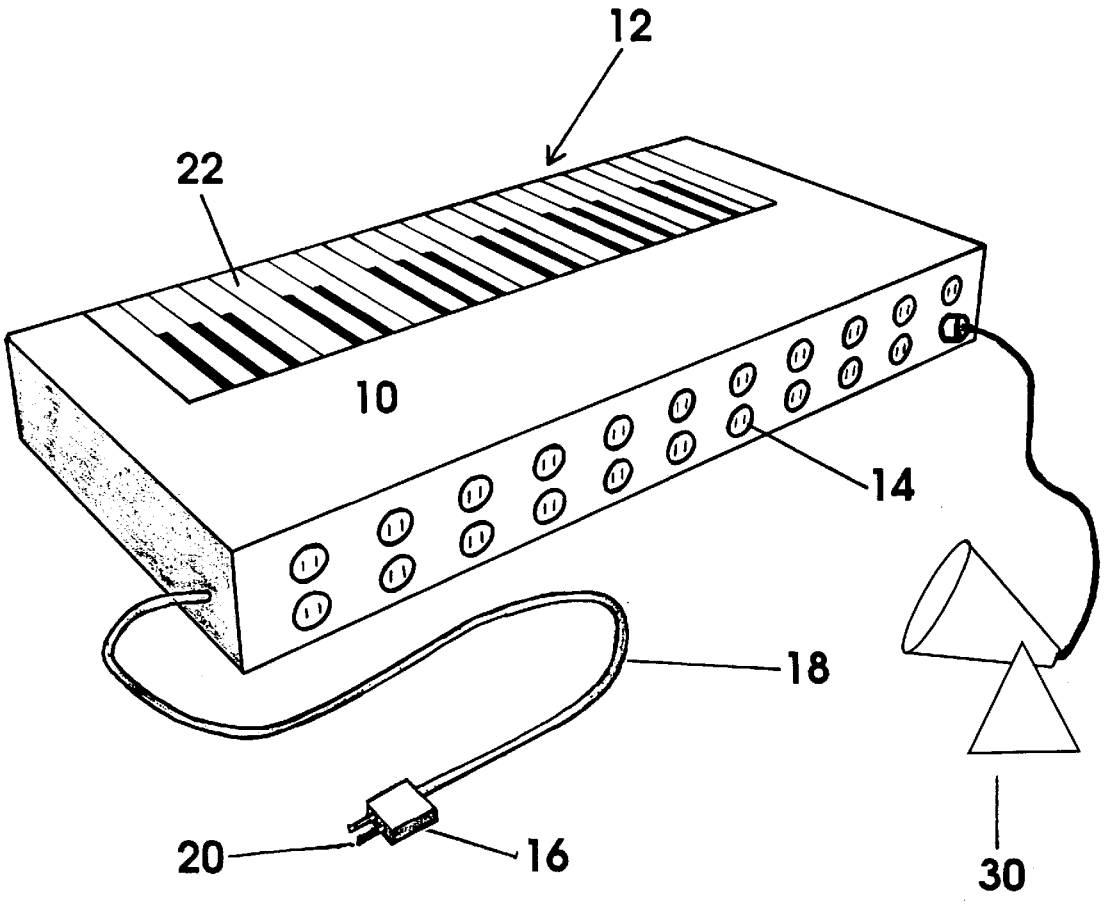
FIG. 1 shows a rear perspective view of the light control keyboard.
Figure 2:
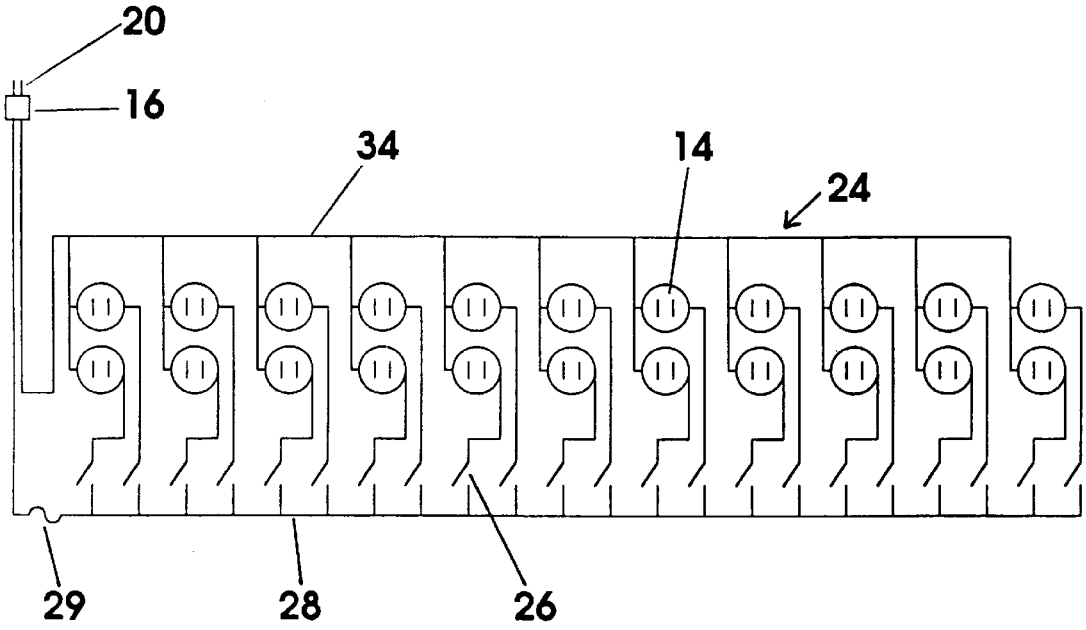
FIG. 2 shows an electrical schematic diagram of the light control keyboard.

Description—FIGS. 1 to 2

A typical embodiment of the present invention is illustrated in FIG. 1 (rear perspective view) and FIG. 2 (electrical schematic diagram). The light control keyboard has a housing 10 consisting of a rigid material such as plastic or other suitable materials, and is adapted to rest on a table or stand. A piano key bed 12 is mounted in the external surface of housing 10. A plurality of keys 22 make up the key-bed 12. Each key 22 mechanically activates and deactivates the light control circuits illustrated in FIG. 2. Mounted in the back of the light control keyboard (FIG. 1) is a plurality of conventional receptacles 14. The receptacles 14 each receive the male contacts of a plug connector of various lights or light banks 30 for electrical interconnection with the circuitry of the light control keyboard (FIG. 1). On the side of the light control keyboard an insulated electrical cord 18 enters the housing 10. Insulated electrical cord 18 terminates in a plug connector 16 having extending contacts 20. Extending contacts 20 are inserted in a common wall outlet with a 110 volt line current.

Referring to control circuit FIG. 2 is a diagram comprising a plurality of individual light control circuits 24. The circuits 24 each draw current from a conventional 110 volt line. An electrically conductive positive circuit line 28 is common to each of the individual circuits. In line on the positive circuit line 28 is a fuse 29 of rated value to open before the current reaches a level which would injure the principle elements of the circuit FIG. 2. Each individual control circuit 24 comprises a switch 26 connected to a positive circuit line 28. A negative circuit line 34 is connected to each receptacle 14. Upon activation of switch 26 by a piano key 22 FIG. 1 the circuit is completed. Each receptacle 14 provides a means for interchangeable electrical engagement of light devices.

The light control circuit FIG. 2 incorporates receptacles 14, one contact of which being connected to the neutral circuit line 34 and the other contact being in series with the positive circuit line 28 by way of a switch 26.

The light control keyboard is connected to a conventional 110 volt line current source with a conventional plug connector 16 having suitable extending contacts 20. The design of the circuit is limited by the requirement that it not illuminate so many lights at one time so as to overload the line current provided.

From the description above, a number of advantages of my light control keyboard become evident:

(a) The light control keyboard is portable and easily located near a display area.

(b) The light control keyboard utilizes a piano type keyboard which gives a great deal of versatility to the operator.

(c) The light control keyboard will allow any operator the opportunity to play the lights without any musical training.

(d) A large variety and number of lights can be used in connection with the light control keyboard.

Operation—FIGS. 1, 2

The manner of using the light control keyboard to illuminate lights is comparable to playing a keyboard instrument. Namely, plug 16 with extending contacts 20 is inserted into a conventional outlet (not shown). Power enters the light control keyboard FIG. 1 through an insulated cord 18. When a key 22 is depressed a switch 26 completes the electrical circuit 24 and electrical power is supplied to a receptacle 14 into which a light or bank of lights 30 is connected. As long as key 22 is depressed the current will flow to receptacle 14. When key 22 is released the current flow stops and key 22 returns to its rest position.

CONCLUSION, RAMIFICATIONS, AND SCOPE

Accordingly, the reader will see that the light control keyboard can be used to easily and conveniently illuminate lights. Utilizing the versatility of a piano type keyboard the lights can be played with all the variety of combinations that a piano keyboard can accomplish. Furthermore, the light control keyboard has advantages in that

- the light control keyboard permits an unskilled operator of any age the opportunity to play the lights without the skills required to play a musical instrument.
- the light control keyboard can be played without the fear of making a mistake such as when playing a musical instrument and a wrong note is played.
- the light control keyboard is portable and can be taken to a location where a light display is desired.
- many types and designs of lights and lighting devices are available. Numerous combinations can be attached to the light control keyboard for unlimited visual combinations.
- the operator of the light control keyboard can accompany music from any source and provide an entertaining visual display.

Although the description above contains many specificity's, these should not be construed as limiting the scope of the invention but as merely providing illustrations of presently preferred embodiments of this invention. For example, the light control keyboard could have more or less piano type keys. The housing of the invention could be larger or smaller that the one pictured in FIG. 1. The connectors between the light player and the attached lights could be a receptacle (as shown in FIG. 1), an extension cord with a female plug into which lights are connected, or an insulated wire using another form of connection. Dimmer controls could be incorporated to control the intensity of the lights.

Thus the scope of the invention should be determined by the appended claims and their legal equivalents, rather than by the examples given.

I claim:

1. A portable light control device for controlling a plurality of lights comprising:

a) a housing including piano keys, an electrical control circuit and conventional receptacle connecting means; wherein b) respective piano keys are mounted on said housing to respectively manually control said lights, and c) said electrical control circuit is operated by said piano keys, and d) said control circuit comprises a plurality of individual light control circuits and e) said conventional receptacle connecting means interchangeably electrically engages light devices including said lights wherein respective connected light devices are activated when respective light control circuits are activated.

2. Light control device of claim 1 wherein the individual light control circuits utilize respective piano keys to operate switches.

* * * * *